US006234079B1

(12) United States Patent
Chertkow

(10) Patent No.: US 6,234,079 B1
(45) Date of Patent: May 22, 2001

(54) REUSABLE DIGITAL PRINTING PLATE

(75) Inventor: Roberto Igal Chertkow, 6B/8 Har Hermon, 77041 Ashdod (IL)

(73) Assignees: Roberto Igal Chertkow, Ashdod; Uri Freiman, Kiryat, both of (IL)

( * ) Notice: Subject to any disclaimer, the term of this patent is extended or adjusted under 35 U.S.C. 154(b) by 0 days.

(21) Appl. No.: 09/281,793

(22) Filed: Mar. 31, 1999

Related U.S. Application Data

(60) Provisional application No. 60/111,277, filed on Dec. 7, 1998.

(51) Int. Cl.[7] ..... B41N 1/00; B41N 6/00; B41C 1/00

(52) U.S. Cl. ..... 101/395; 101/401.1; 428/908

(58) Field of Search ..... 428/72, 116, 118, 428/178, 304.4, 900, 908; 101/401.1, 395, 150, 170, 153, 483, 489, 493; 347/111; 346/21, 150.1, 77, 104; 399/343, 356, 130, 136, 143, 168, 169

(56) References Cited

U.S. PATENT DOCUMENTS 2,338,558 * 1/1944 Wickwire, Jr. ..... 101/401.1
3,589,289 * 6/1971 Gosnell et al. ..... 101/395

* cited by examiner

*Primary Examiner*—Kimberly L. Asher
(74) *Attorney, Agent, or Firm*—Mark M. Friedman

(57) ABSTRACT

A reusable printing plate for recess or relief printing. The reusable printing plate features a number of adjacent printing cells, each of which can be independently alternated between a printing mode and a non-printing mode. In the printing mode the printing cell acquires a configuration for receiving and retaining a printing substance. In the non-printing mode the printing cell acquires a configuration which does not receive and retain the printing substance.

21 Claims, 16 Drawing Sheets

REUSABLE DIGITAL PRINTING PLATE

This is a U.S. provisional Pat. application Ser. No. 60/111,277, filed Dec. 7, 1998.

FIELD AND BACKGROUND OF THE INVENTION

The present invention relates to digital printing and, more particularly, to a reusable digital printing plate for recess and/or relief printing.

Nowadays, it is common to use digital and computerized means to draw and transfer the data to be impressed, either directly to the printing machine, or via certain pre-press preparations, thereby facilitating also the printing make-ready process. Low-end printing applications generally use small digital printers based on impact (usually dot matrix), ink jet or laser printing techniques. The printing quality varies then from plain to high-quality printing, wherein the digital information sent directly to the printing mechanism enables fast on-line modifications of the printing layout.

Middle range applications usually use commercial printers for fast printing and high quality of medium quantities (thousands) of printouts of a wide range of products such as announcements, brochures, posters, booklets, fliers, stationery, business forms, books and magazines.

Generally, the size of the printing machines intended to be used in service bureaus is less important. These machines use sophisticated methods of printing based on transfer of an entire film of colored ink to the paper at each cycle, utilizing digital means for drawing production and data transfer.

In recently announced printing machines, fast updating of the reproductions is possible. Although the change of the appearance of consecutive printouts is generally not crucial, personalized printouts can be done, based on the digital capabilities of the printing machine. The TurboStream system made by Indigo is an example of a sheet-fed digital printing device, with the option of full-color personalization of text, graphics and images.

For high-end applications, such as journals, newspapers, etc., very high volumes of printing (over tens of thousands) are necessary. Generally, media for high quality printouts are required. The same output is repeated many times, and personalized printings are rare. Existing printing systems use printing plates of various materials, such as metal (usually aluminum), paper, rubber or plastic, carrying an image to be reproduced using a printer press. The structure of the printing plates depends on the printing process. For example, recess (intaglio) printings, like gravure, rotogravure using a web press, and engraving, use printing plates with different levels for inked areas and non-inked areas, having inked areas recessed related to the non-inked areas; whereas relief printings, like letterpress, block printing and flexography, also use printing plates with different levels for inked areas and non-inked areas, but in this case the inked areas protrude over the non-inked areas.

Another common printing method is lithography, using plates whose image areas attract ink and whose non-image areas repel ink. However, existing printing plates are difficult to reuse and personalize, and their storage, especially for the case of metal plates for printing large size paper sheets, is space consuming. Furthermore, plate making is usually time-consuming and cumbersome, though advanced techniques of computer-to-plate (CTP) somewhat facilitate this process.

There is thus a widely recognized need for, and it would be highly advantageous to have, a reusable digital printing plate, for middle range to high-end applications, that is simple and straightforward to manufacture, operate and use.

SUMMARY OF THE INVENTION

According to one aspect of the present invention there is provided a reusable printing plate for recess or relief printing, the reusable printing plate comprising a plurality of adjacent printing cells, each of the plurality of adjacent printing cells being independently alternatable at least between a printing mode, in which a printing cell of the plurality of adjacent printing cells acquires a first configuration adapted for receiving and retaining thereat a printing substance, and a non-printing mode, in which a printing cell of the plurality of adjacent printing cells acquires a second configuration adapted for not receiving or retaining thereat the printing substance.

According to further features in preferred embodiments of the invention described below, the reusable printing plate further comprising an internal mechanism for independently alternating each of the plurality of adjacent printing cells between the printing and non-printing modes.

According to another aspect of the present invention there is provided a recess or relief printing method comprising the steps of (a) providing a reusable printing plate including a plurality of adjacent printing cells, each of the plurality of adjacent printing cells being independently alternatable at least between a printing mode, in which a printing cell of the plurality of adjacent printing cells acquires a configuration adapted for receiving and retaining thereat a printing substance, and a non-printing mode, in which a printing cell of the plurality of adjacent printing cells acquires a configuration adapted for not receiving or retaining thereat a printing substance; (b) further providing a mechanism for independently alternating each of the plurality of adjacent printing cells between the printing and non-printing modes; (c) via the mechanism, selecting printing cells of the plurality of adjacent printing cells to be in the printing mode; (d) providing printing cells being in the printing mode with the printing substance; and (e) transferring at least a portion of the printing substance from the printing cells being in the printing mode to a printable substrate.

According to yet another aspect of the present invention there is provided a printing system comprising (a) a reusable printing plate for recess or relief printing including a plurality of adjacent printing cells, each of the plurality of adjacent printing cells being independently alternatable at least between a printing mode, in which a printing cell of the plurality of adjacent printing cells acquires a first configuration adapted for receiving and retaining thereat a printing substance, and a non-printing mode, in which a printing cell of the plurality of adjacent printing cells acquires a second configuration adapted for not receiving or retaining thereat the printing substance; and (b) an external mechanism for independently alternating each of the plurality of adjacent printing cells between the printing and non-printing modes.

According to further features in preferred embodiments of the invention described below, printing cells of the plurality of adjacent printing cells which are in the printing mode are elevated respective to printing cells of the plurality of adjacent printing cells which are in the non-printing mode, so that providing the printing cells being in the printing mode with the printing substance is effected by applying the printing substance onto elevated regions of the reusable printing plate.

According to still further features in the described preferred embodiments printing cells of the plurality of adjacent printing cells which are in the printing mode are recessed respective to printing cells of the plurality of adjacent printing cells which are in the non-printing mode, so that providing the printing cells being in the printing mode with the printing substance is effected by applying the printing substance into recessed regions of the reusable printing plate.

According to still further features in the described preferred embodiments each of the adjacent printing cells includes a stationary guiding element and a translating element translatable within the stationary guiding element, so that selecting printing cells of the plurality of adjacent printing cells to be in the printing mode is effected by selectively translating translating elements with respect to their stationary guiding elements.

According to still further features in the described preferred embodiments the translating element includes a flexible membrane connecting the stationary guiding element and the translating element.

According to still further features in the described preferred embodiments the translating element includes a membrane selected from the group consisting of a buckling membrane, a bi-material (e.g., bi-metal) element membrane and a shape memory alloy membrane.

According to still further features in the described preferred embodiments the mechanism for independently alternating each of the plurality of adjacent printing cells between the printing and non-printing modes operates by selectively actuating or deactuating electrostatic attraction or repulsion forces to thereby translate the translating elements in respect to their stationary guiding elements.

According to still further features in the described preferred embodiments the mechanism for independently alternating each of the plurality of adjacent printing cells between the printing and non-printing modes operates by selectively actuating or deactuating magnetic or electromagnetic attraction or repulsion forces to thereby translate the respective translating elements in respect to their stationary guiding elements.

According to still further features in the described preferred embodiments the mechanism for independently alternating each of the plurality of adjacent printing cells between the printing and non-printing modes operates by selectively applying mechanical forces to thereby translate the respective translating elements in respect to their stationary guiding elements.

The present invention successfully addresses the shortcomings of the presently known configurations by providing a reusable digital printing plate, for middle range to high-end applications, that is simple and straightforward to manufacture, operate and use.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
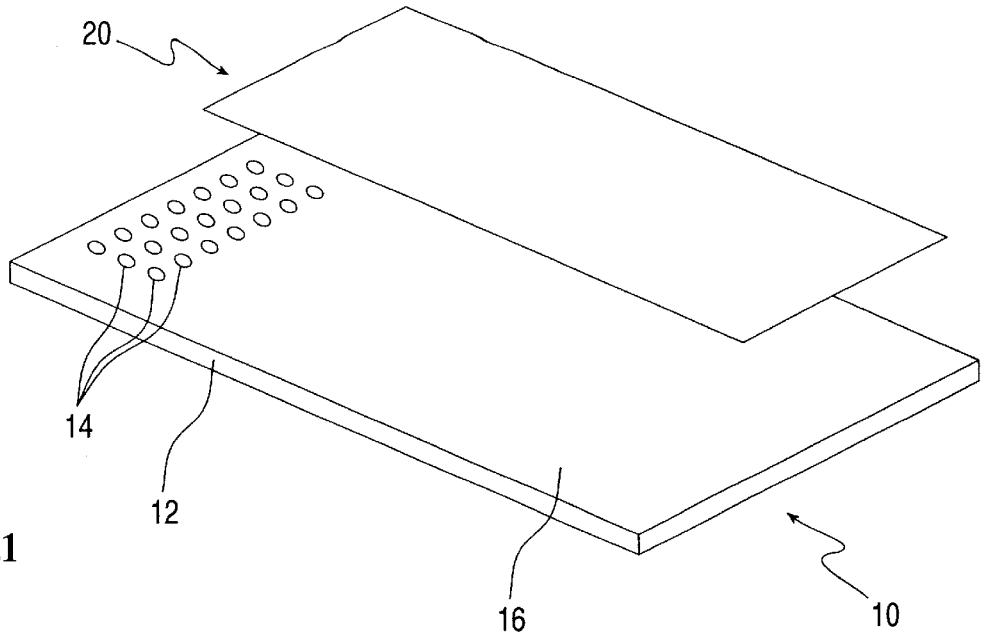
FIG. 1 is a schematic view of a printing plate and a printable substrate according to the present invention.

The present invention is of a reusable digital printing plate which can be used for recess and/or relief printing. Specifically, the present invention can be used to replace the disposable printing plates which are currently employed in recess and/or relief printing processes and to facilitate personalized printing.

The principles and operation of printing plates according to the present invention may be better understood with reference to the drawings and accompanying descriptions.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Referring now to the drawings, FIG. 1 illustrates a printing plate according to the present invention, which is referred to hereinbelow as printing plate 10.

As further detailed hereinunder printing plate 10 according to the present invention can be used in recess and/or relief printing processes and it is highly compatible with digital printing processes.

Printing plate 10 includes a substrate 12. Substrate 12 is formed with a plurality of adjacent printing cells 14 arranged over a printing face 16 thereof. Each of printing cells 14 is independently alternatable at least between a printing mode, in which a printing cell 14 acquires a first configuration adapted for receiving and for holding thereat a printing substance (e.g., a liquid or powder printing substance, such as, but not limited to, ink, caustic substance, glue, etc.), and a non-printing mode, in which a printing cell 14 acquires a second configuration adapted for not receiving or retaining thereat a printing substance.

According to a preferred embodiment of the present invention cells 14 are arranged in an array or grid of linear columns and rows of cells 14, wherein each of cells 14 represents a pixel of a digital image, such as a digital image of a single color of a color separated image.

Figure 2A:
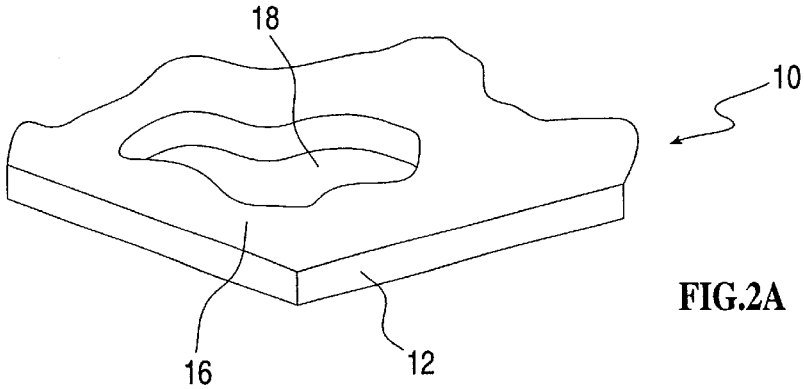
FIGS. 2*a–b* illustrate recess and relief printing using the printing plate according to the present invention.
Figure 2B:
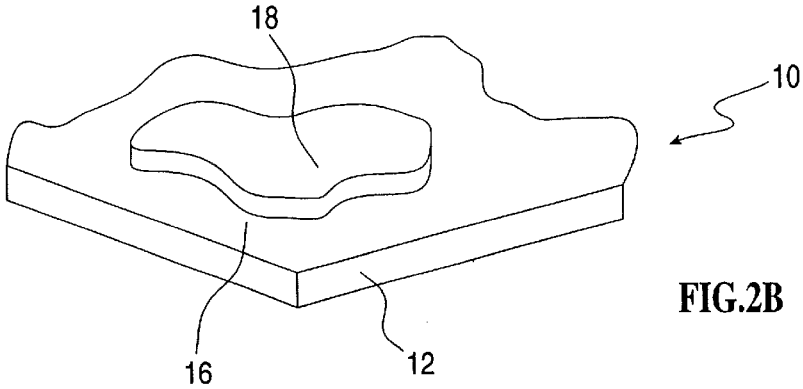

As shown in FIGS. 2*a–b,* according to a preferred embodiment of the present invention, groups (i.e., one or more) of cells 14, marked at 18, can be recessed (FIG. 2*a*) or elevated (FIG. 2*b*) with respect to printing face 16 of substrate 12, so as to effect recess printing in which recesses formed in face 16 receive and retain a printing substance, or to effect relief printing, in which elevations (relieves) formed in face 16 receive and retain the printing substance.

Typically, in relief printing the printing substance is applied only to the elevated regions of the printing plate, whereas in recess printing the printing substance is applied all over the plate, while excess thereof is thereafter removed from all portions of the plate other that the recessed portions. Removal of the excess printing substance in from non-recessed regions of the plate in recess printing is typically effected by a knife-edge used to scan the plate surface, as well known in the art.

Therefore, as used herein in the specification and in the claims section that follows, the phrase "adapted for not receiving or retaining thereat a printing substance" refers to—not receiving the printing substance—in relief printing and further to—not holding the printing substance after removal of excess of the printing substance—in recess printing.

As further described and exemplified hereinunder, printing plate 10 according to a preferred embodiment of the present invention further includes an internal mechanism for enabling independent alternation of each of printing cells 14 between the printing and the non-printing modes thereof, rendering printing plate 10 according to the present invention reusable in the sense that it can be used to print different images at different time periods by appropriately transforming selected cells 14 from their printing mode to their non-printing mode and vice versa.

Alternatively, according to another preferred embodiment of the present invention an external mechanism for enabling independent alternation of each of printing cells 14 between the printing and the non-printing modes thereof is provided in a system along with printing plate 10, to thereby similarly render printing plate 10 according to the present invention reusable in the sense that it can be used to print different images at different time periods by appropriately transforming selected cells 14 from their printing mode to their non-printing mode and vice versa.

In both cases, however, providing printing cells 14 which are in the printing mode with the printing substance and transferring at least a portion of the printing substance from printing cells 14 containing same to a printable substrate 20 (shown in FIG. 1), such as, but not limited to, paper, plastic, metal, carton, glass, etc., results in the formation of a printed image thereon.

Thus, if printing cells 14 which are in the printing mode are elevated respective to printing cells 14 which are in the non-printing mode, providing printing cells 14 being in the printing mode with the printing substance is effected by applying the printing substance onto elevated regions 18 of reusable printing plate 10, whereas, if printing cells 14 which are in the printing mode are recessed respective to printing cells 14 which are in the non-printing mode, providing printing cells 14 being in the printing mode with the printing substance is effected by applying the printing substance into recessed regions 18 of reusable printing plate 10.

Figure 3A:
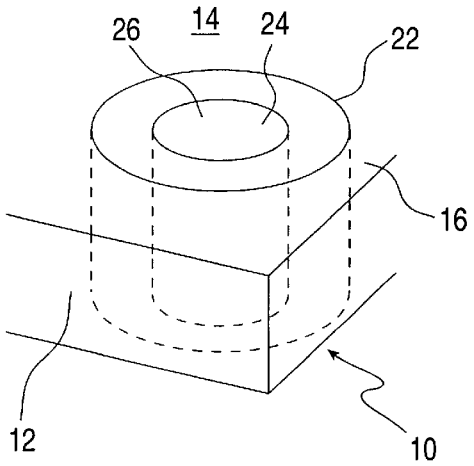
FIGS. 3*a–c* are perspective views of printing cells used in the printing plate according to one embodiment of the present invention.
Figure 3B:
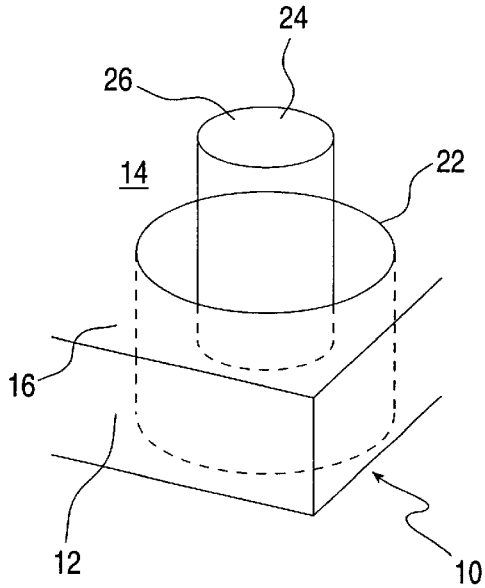
Figure 3C:
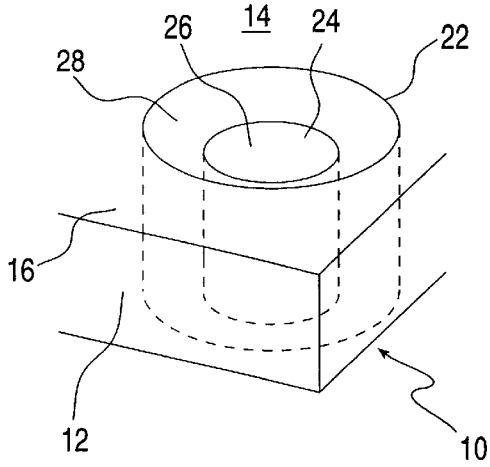

As shown in FIGS. 3*a–c,* according to a preferred embodiment of the present invention each of printing cells 14 includes a stationary guiding element 22 and a translating element 24 which is translatable within stationary guiding element 22, wherein selecting printing cells 14 to be in a printing mode or a non-printing mode is effected by selectively translating translating elements 24 with respect to their stationary guiding elements 24.

Thus, for relief printing, cells 14 are transformed from their non-printing mode, shown in FIG. 3*a,* in which a face 26 of translating element 24 is substantially leveled with face 16 of printing plate 10, to their printing mode, shown in FIG. 3*b,* in which face 26 of translating element 24 protrudes from face 16 of printing plate 10, and is capable of receiving and retaining thereon a printing substance, whereas for recess printing, cells 14 are transformed from their non-printing mode, shown in FIG. 3*a,* to their printing mode, shown in FIG. 3*c,* in which face 26 of translating element 24 is recessed respective to face 16 of printing plate 10, such that a cavity 18 capable of receiving and retaining a printing substance is formed in the space evacuated by element 24.

As further detailed hereinunder, guiding elements 22 are preferably holes or recesses formed in, or regions of a pliable material introduced into, substrate 12 of printing plate 10, whereas translating elements 24 are formed of various types of membranes, miniature pins or combinations thereof. These elements can be fabricated using well known micromechanical fabrication techniques, including, but not limited to, selective and patterned etching and/or microplating.

Figure 4A:
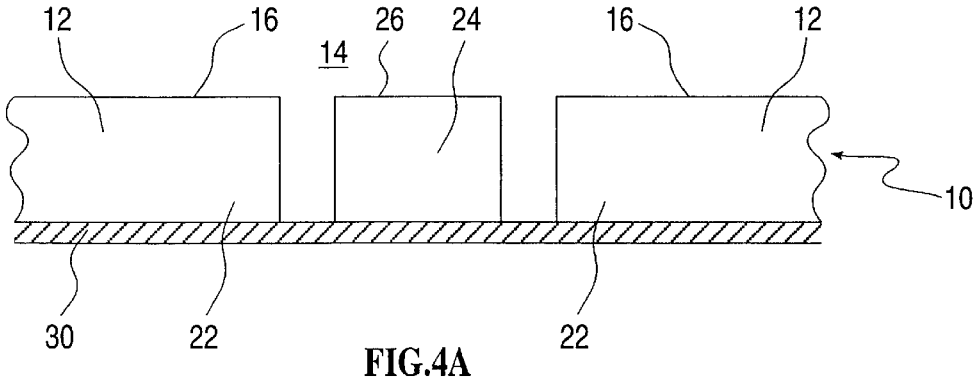
FIGS. 4*a–e* and 5*a–h* are cross sectional views of printing cells used in the printing plate according to yet another embodiment of the present invention, including an internal or external magnetic or electromagnetic actuating/retaining mechanism.
Figure 4B:
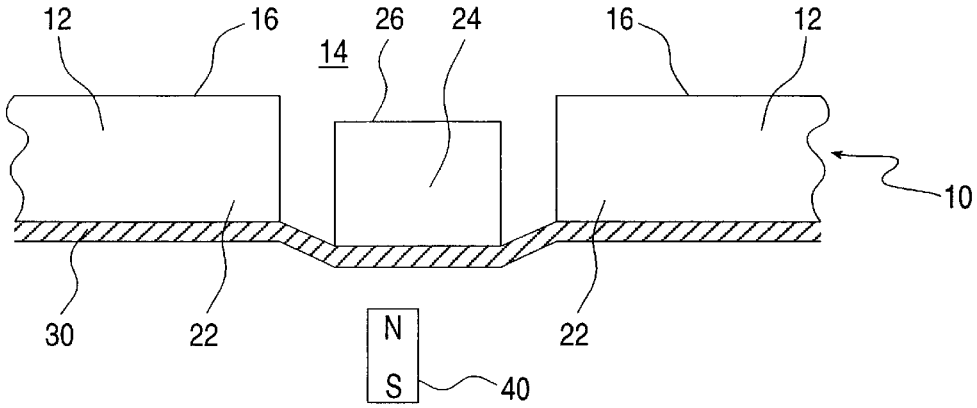

As shown in FIGS. 4*a–*4*e,* according to a preferred embodiment of the present invention translating element 24 includes a flexible membrane 30. Membrane 30 serves for connecting stationary guiding element 22 and translating element 24 while, by being flexible, allows the translation of element 24 with respect to element 22. In FIG. 4*a,* element 24 is selected (sized) such that when membrane 30 is in its resting position, face 26 of element 24 levels with face 26 of plate 10. As shown in FIGS. 4*b* and 4*c,* in this case, pulling membrane 30 in a direction away from, or closer to, face 16 of plate 10, respectively, results in a cell 14 being in a printing mode, i.e., adapted at receiving and retaining a printing substrate.

Figure 4D:
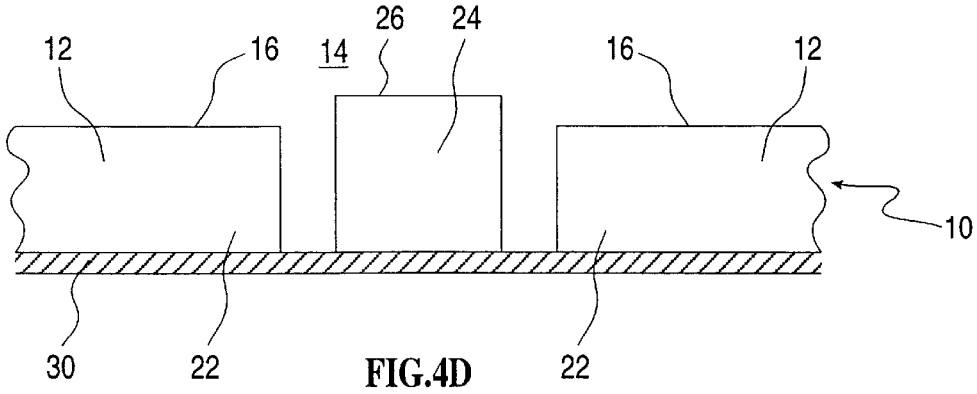
Figure 4E:
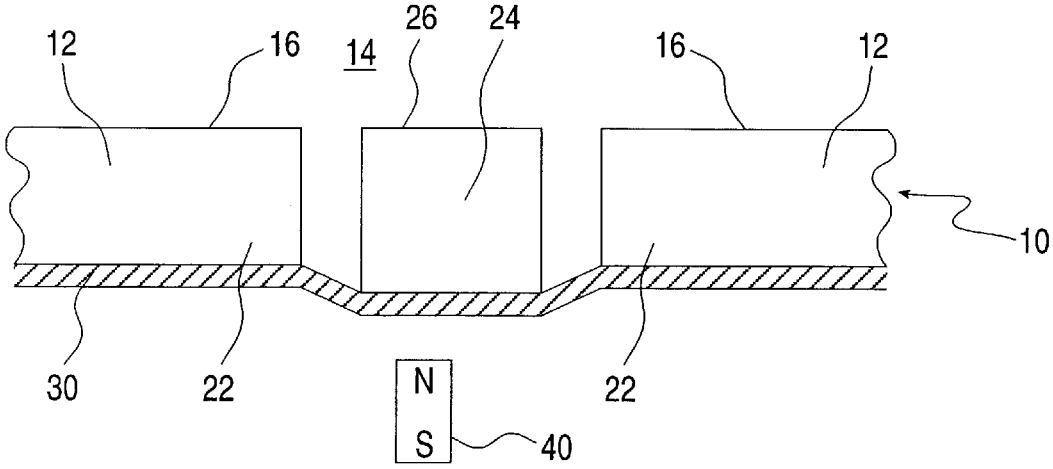
Figure 4C:
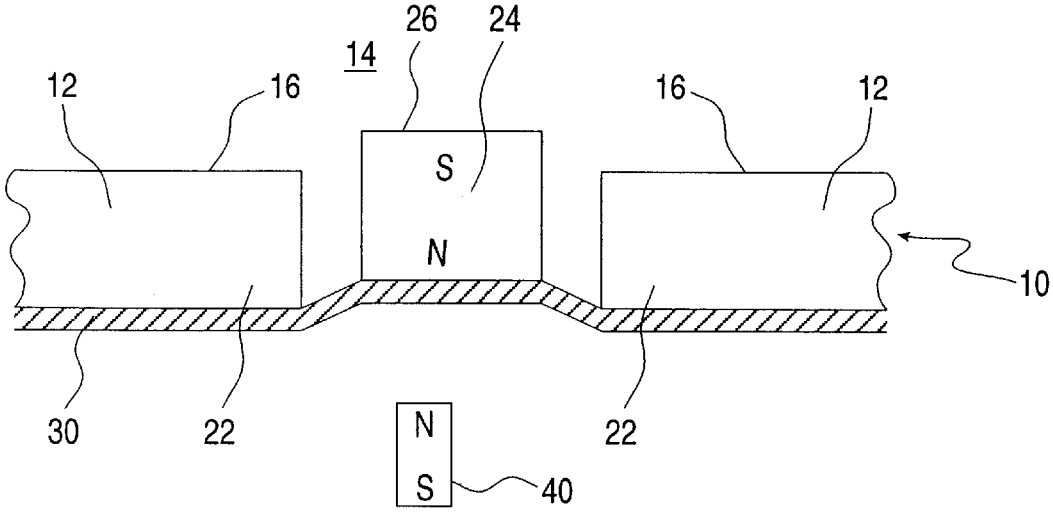

A somewhat different configuration is shown in FIGS. 4*d–e.* In FIG. 4*d,* element 24 is selected (sized) such that when membrane 30 is in its resting position, face 26 of element 24 protrudes from face 16 of plate 10 and is therefore applicable for relief printing. As shown in FIGS. 4*e,* in this case, pulling membrane 30 in a direction away from, or closer to, face 16 of plate 10, respectively, results in a cell 14 being in a non-printing mode, as face 26 of its translating element 24 levels with face 16 of plate 10.

Preferably, a single membrane 30 covering the non-printing face of plate 10 is employed, wherein regions thereof corresponding to individual cells 14 are individually controlled to function as described herein and as further detailed in the following sections.

Figure 5A:
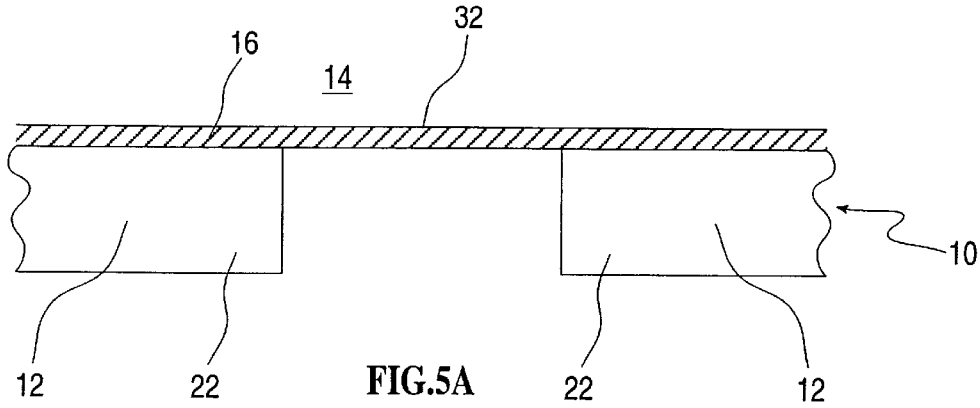
Figure 5B:
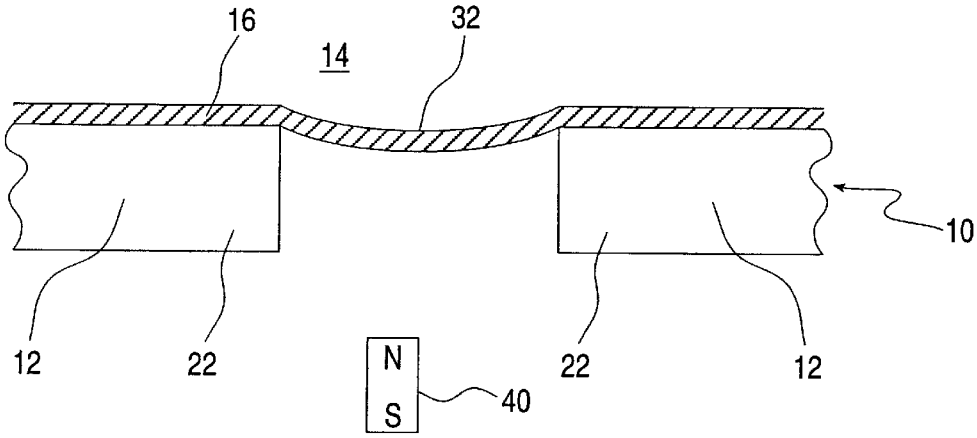
Figure 5C:
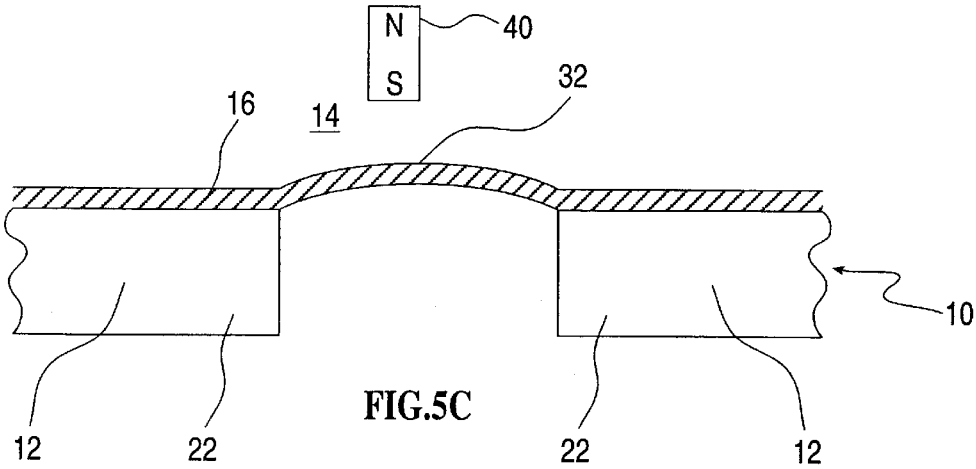
Figure 5D:
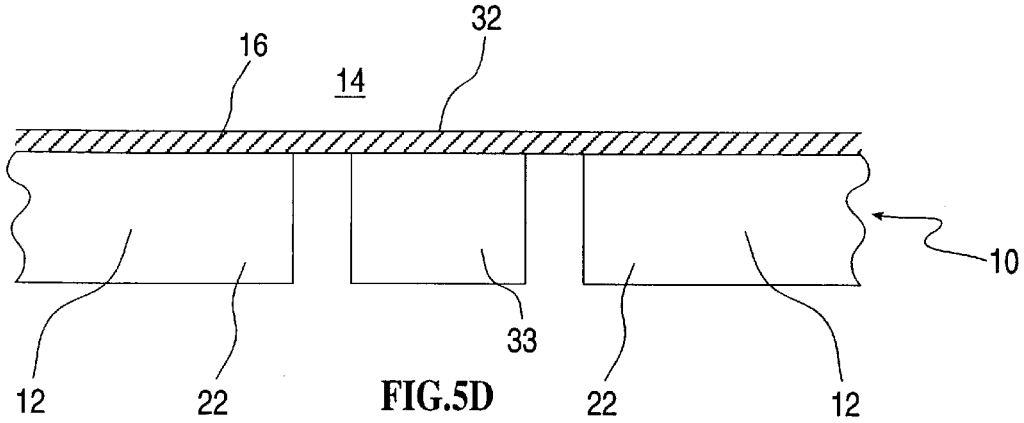
Figure 5E:
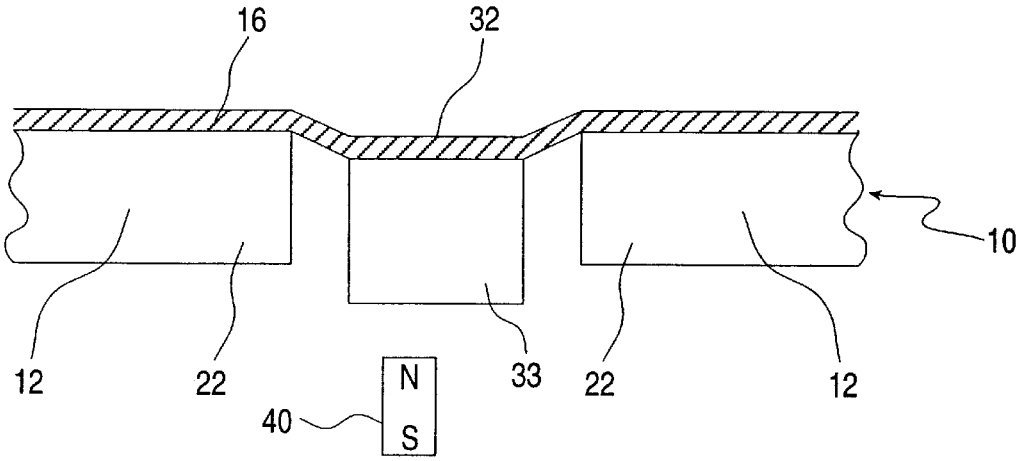
Figure 5F:
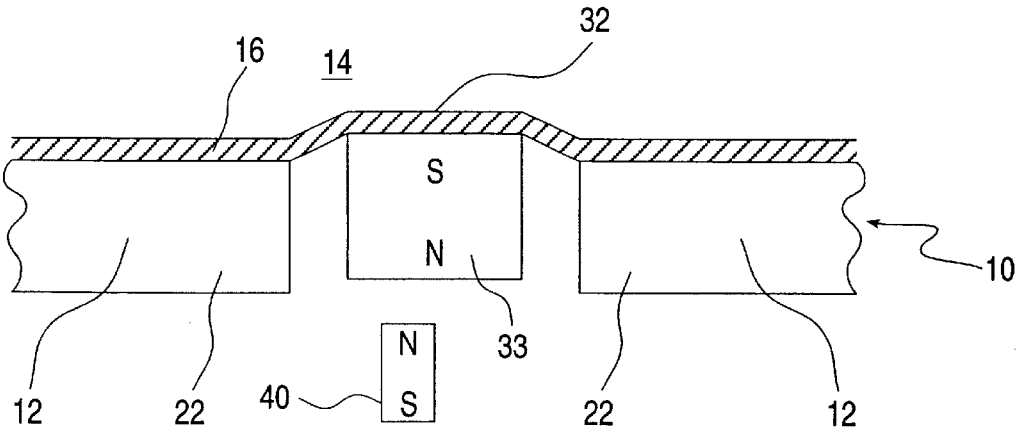

As shown in FIGS. 5*a–*5*e,* according to another preferred embodiment of the present invention translating element 24 of each of cells 14 includes a flexible membrane 32 which covers stationary guiding element 22. In FIG. 5*a* membrane 32 levels with face 16 of plate 10 and it renders cell 14 to acquire its non-printing mode. In FIGS. 5*b–c* membrane 32 is translated so as to recess or protrude from surface 16 of plate 10, so as to transform cell 14 into its printing mode for recess or relief printing, respectively. A similar situation is depicted in FIGS. 5*d–f.* In this case, an additional component 33, which co-translates with membrane 32 is attached thereto so as to control its translation.

Figure 5G:
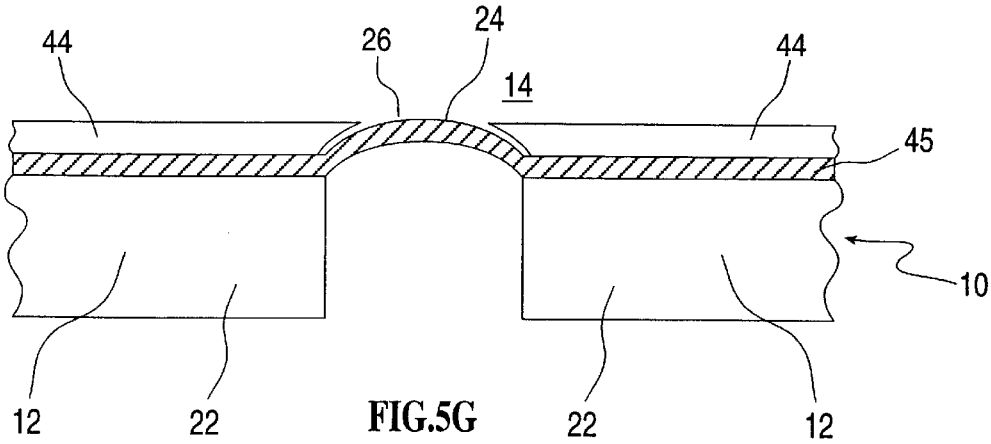
Figure 5H:
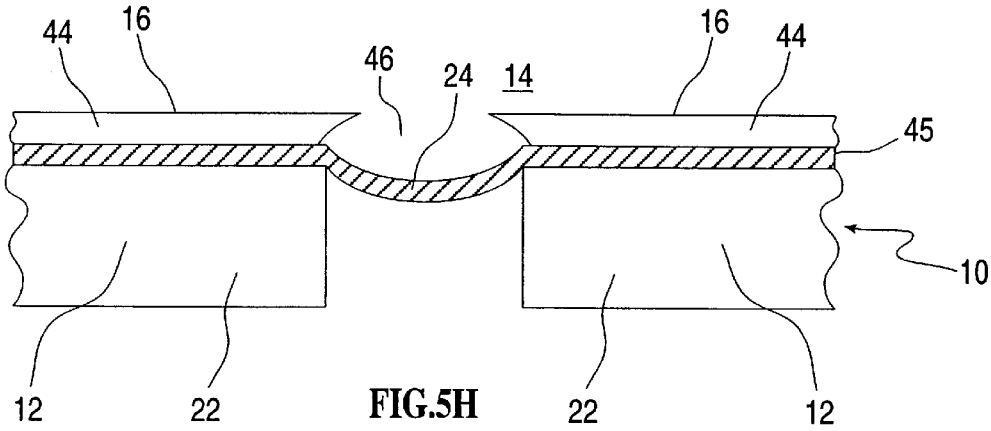

As shown in FIGS. 5*g–h,* according to another preferred embodiment of the present invention translating element 24 is a portion of a membrane 45 selected from the group consisting of a buckling membrane, a bi-material (e.g., bi-metal) element membrane and a shape memory alloy membrane. Such a membrane can acquire a bent configuration by (i) buckling, through the application of pressure beyond a yield point so as to receive a constant buckled form, (ii) heating/cooling of single or bi-materials to achieve temporary buckling, or (iii) deposition on a previously formed curved sacrificial surface of the membrane a material so as to receive a curved profile and dissolving the curved surface leaving a curved SMA membrane. The buckling of the SMA membrane can be enforced, as previously explained, by application of pressure beyond its yield point. It must be understood that the use of bi-materials or SMA's may require the use of more than one such element or another type of actuation in combination with others to allow mode exchange of a printing cell. Preferably, a cover 44 formed with an opening is used to increase the volume 46 of cell 14 when transforms into its printing mode (FIG. 5*h*), and closes it by almost leveling it at the none printing mode (FIG. 5*g*).

In the following paragraphs attention is given to a variety of alternative mechanisms that can be used according to the present invention to enable independent alternation of each of printing cells 14 between its printing and non-printing modes.

Thus, in FIGS. 6*a*–8*d* the mechanism for independently alternating each of the plurality of adjacent printing cells between the printing and non-printing modes operates by selectively actuating or deactuating electrostatic attraction or repulsion forces to thereby translate and/or retain the translating elements in respect to their stationary guiding elements.

In FIGS. 4*a*–5*f* the mechanism for independently alternating each of the plurality of adjacent printing cells between the printing and non-printing modes operates by selectively actuating or deactuating magnetic or electromagnetic attraction or repulsion forces to thereby translate and/or retain the respective translating elements in respect to their stationary guiding elements. In this case, if required (i.e., in the absent of self retention properties, e.g., as effected by a buckling membrane), retaining the translated translating elements in their translated position can be effected by applying retaining magnetic, electromagnetic or electrostatic forces.

FIGS. 9*a*–*d* the mechanism for independently alternating each of the plurality of adjacent printing cells between the printing and non-printing modes operates by selectively applying mechanical forces to thereby translate the respective translating elements in respect to their stationary guiding elements. In this case as well, if required, retaining the translated translating elements in their translated position can be effected by applying retaining magnetic, electromagnetic or electrostatic forces.

In general, translating translating elements with respect to their respective stationary guiding elements can be effected by an internal or external translating mechanism, whereas retaining the translating elements in their translated position can be effected either by an inherent property of the translating elements themselves or by an internal retaining mechanism.

FIGS. 6*a*–6*d* illustrate a preferred embodiment of electrostatic actuation for a printing cell 14, in which translating translating element 24 is effected by electrostatic forces formed between conductive parts of element 24 and conductive elements associated with stationary guiding element 22.

Thus, membrane 30 is, or includes therein, an electrode 34, whereas stationary element 22 is made to include a second electrode 36 therein, such that electrodes 34 and 36 are insulated therebetween via a dielectric material, which is realized in the example given by substrate 12 in which stationary element 22 is formed. Electrodes 34 and 36 can be counter electrodes, so as to effect attraction therebetween when charged. Alternatively, electrodes 34 and 36 can be of the same sign, so as to effect repulsion therebetween when charged. In either case, the attraction or repulsion forces are selected strong enough to both translate translating element 24 with respect to stationary element 22 and to retain element 24 in its translated position thereafter. It will, however, be appreciated that the forces required for translating element 24 are about an order of magnitude higher than the forces required to retain it in its translated position. In any case, electrodes 34 and 36 are connected to one or more voltage sources.

Figure 6A:
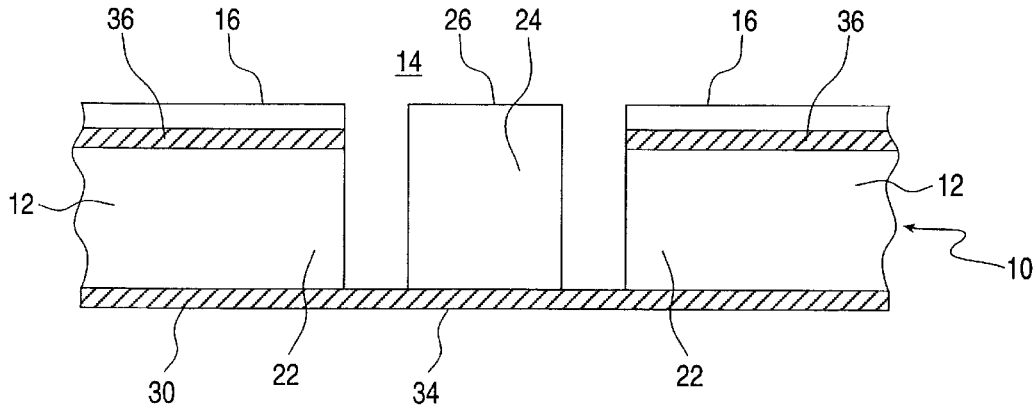
FIGS. 6*a–d*,7*a–d* and 8*a–d* are cross sectional views of printing cells used in the printing plate according to still another embodiment of the present invention, including an internal electrostatic actuating/retaining mechanism.
Figure 6B:
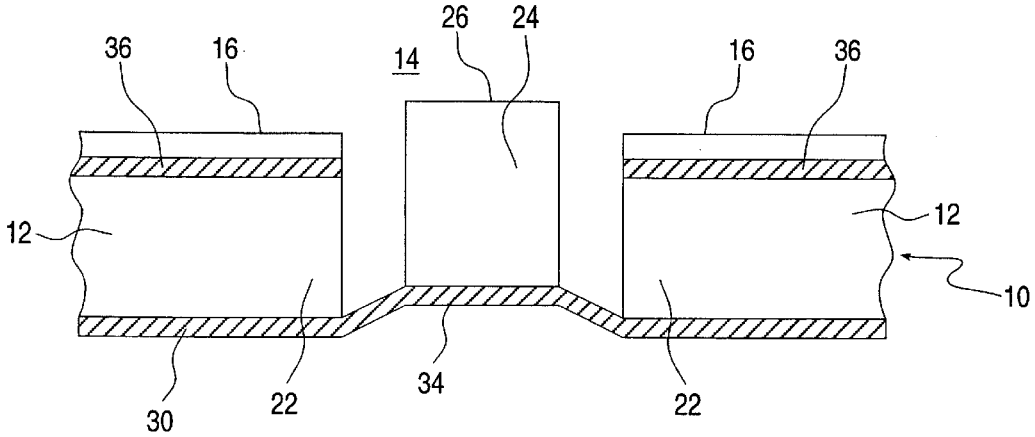

Thus, FIGS. 6*a*–*b* provide an example for relief printing wherein when electrodes 34 and 36 are not charged, face 26 of element 24 levels with face 16 of plate 10, rendering cell 14 to be in its non-printing mode, whereas, when electrodes 34 and 36 are counter charged, and as a result membrane 30 translates closer to electrode 36, face 26 of element 24 protrudes from face 16 of plate 10, transforming cell 14 into its printing mode.

Figure 6C:
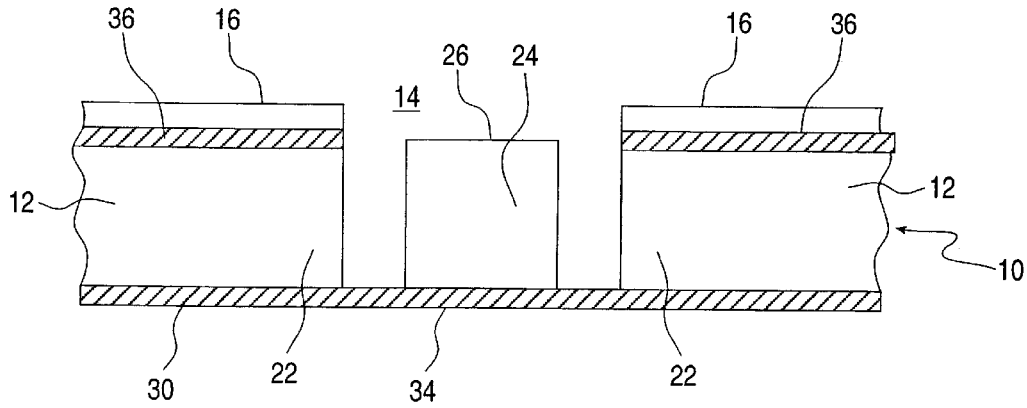
Figure 6D:
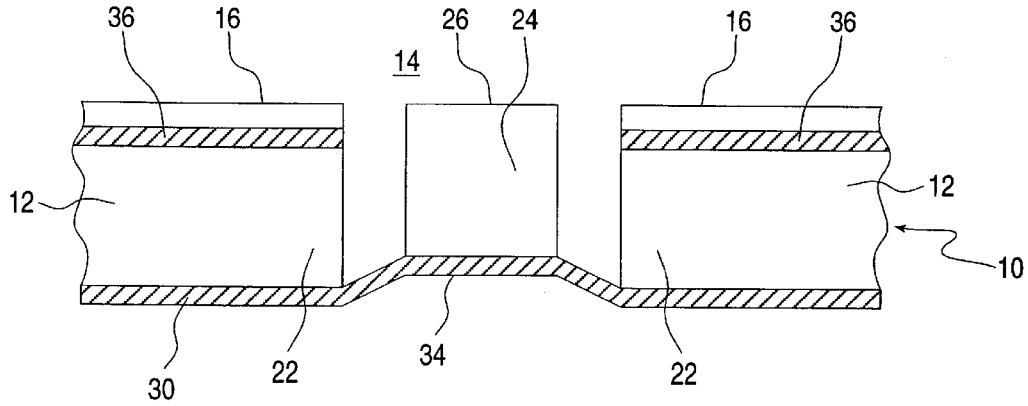
Figure 7A:
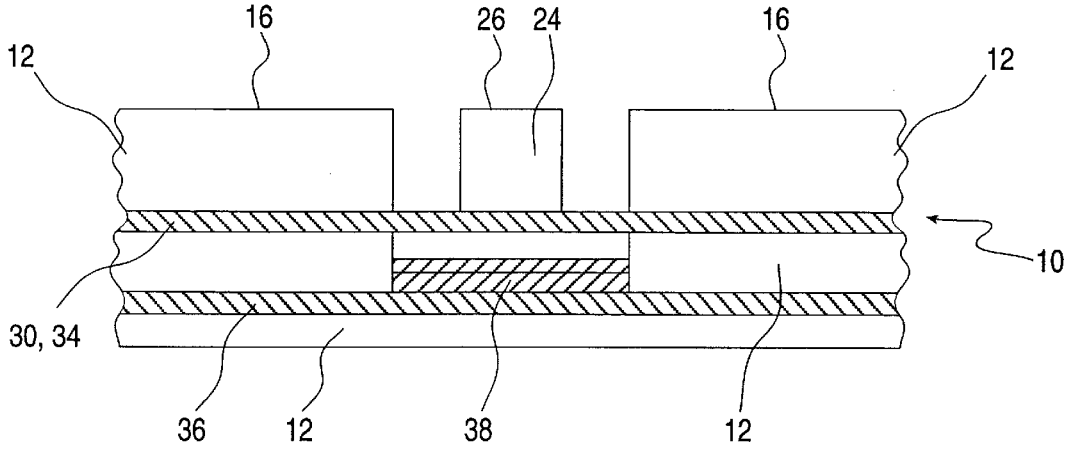
Figure 7B:
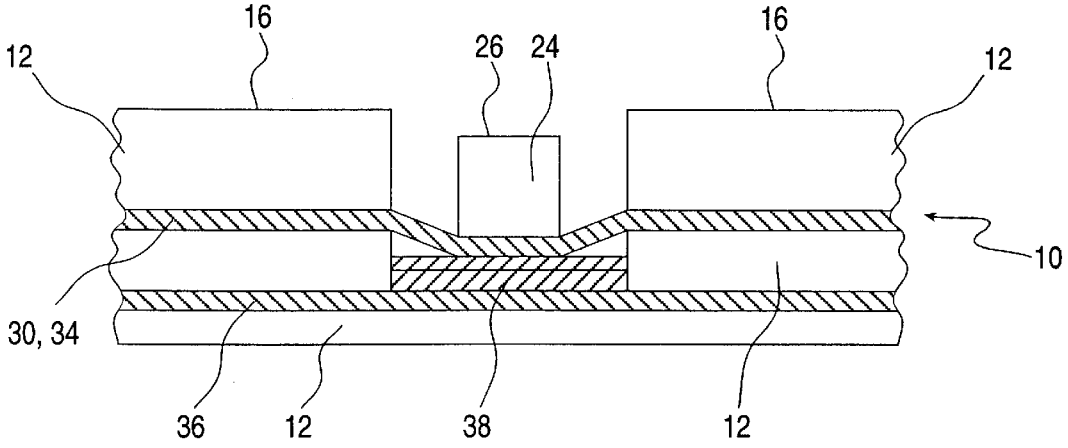
Figure 7C:
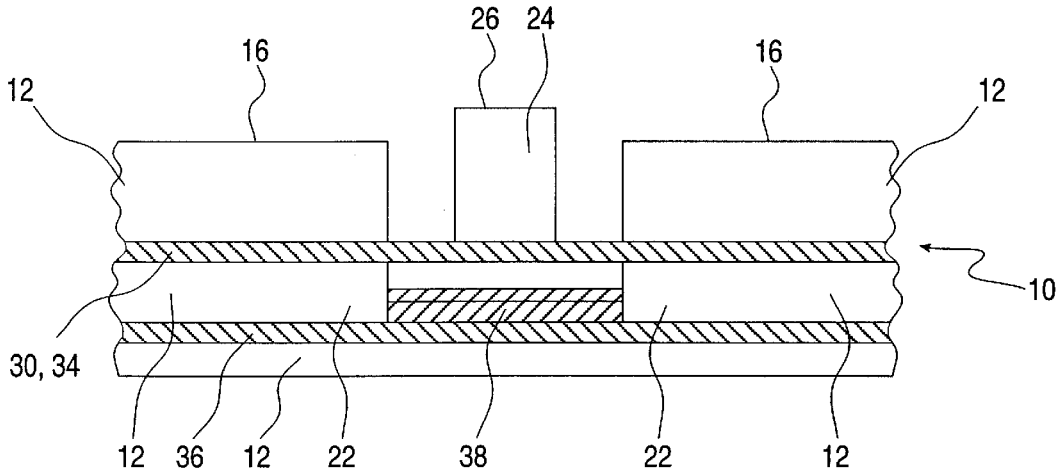
Figure 7D:
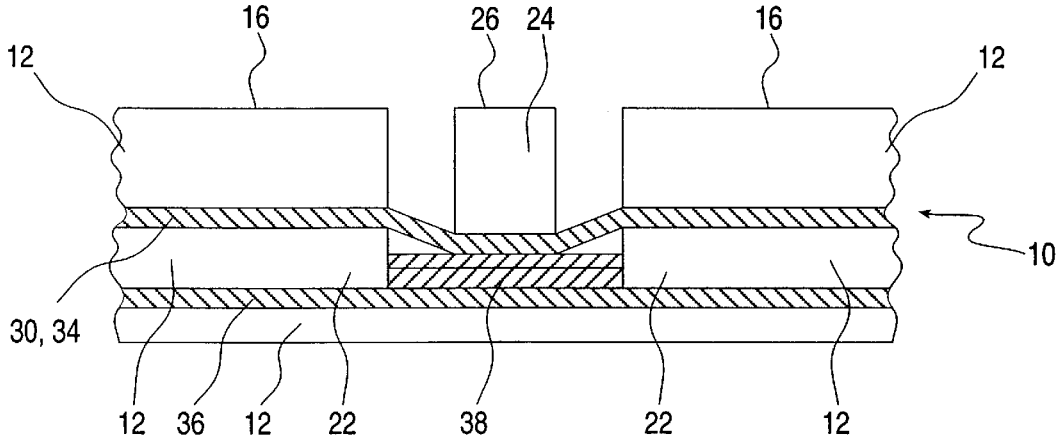

Similarly, FIGS. 6*c*–*d* provide an example for recess printing, wherein when electrodes 34 and 36 are not charged, face 26 of element 24 is recessed relative to face 16 of plate 10, rendering cell 14 to be in its printing mode, whereas, when electrodes 34 and 36 are counter charged, and as a result membrane 30 translates closer to electrode 36, face 26 of element 24 levels with face 16 of plate 10, transforming cell 14 into its non-printing mode.

FIGS. 7*a*–8*d* provide some additional examples wherein electrostatic forces are employed to translate translating element 24 with respect to stationary guiding element 22. In these example, a dielectric layer 38 serves to prohibit electrical contact between membrane 30 and electrode 34 therein with electrode 36. Additionally, the orientation of electrodes 34 and 36 with respect to layer 16 is reversed, to otherwise function as described above with respect to FIGS. 6*a*–*d*.

Referring again to FIGS. 4*a*–5*f*, according to another preferred embodiment of the present invention a magnet or an electromagnet 40 serves to attract or repulse translating element 24 which is selected in this case to be made of a material with is either responsive to a magnetic force, such as a ferrous material, or to be a magnet or an electromagnet itself. It will be appreciated that in the latter case, for example, which is specifically exemplified in FIGS. 4*c* and 5*f*, repulsion can be effected. Magnet or electromagnet 40 can form a part of plate 10. Alternatively, it can be implemented on an actuating device which is brought in close contact with plate 10 or a portion thereof for actuation, and is thereafter removed. In any case, a row or an array of magnets or electromagnets 40 is employed, which row or array geometrically corresponds to a row or array of printing cells 14.

As already mentioned above, in FIGS. 9*a*–*d* the mechanism for independently alternating each of the plurality of adjacent printing cells between the printing and non-printing modes operates by selectively applying mechanical forces to thereby translate the respective translating elements in respect to their stationary guiding elements.

Figure 8A:
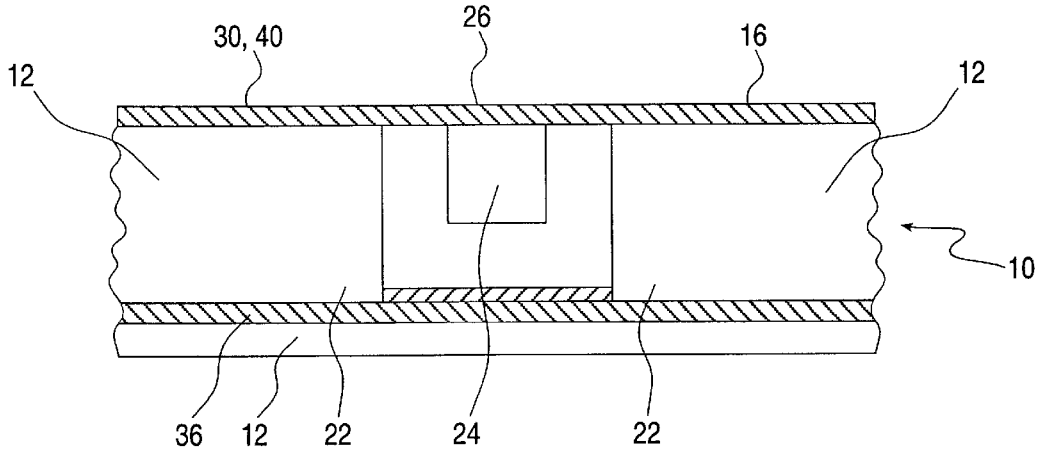
Figure 8B:
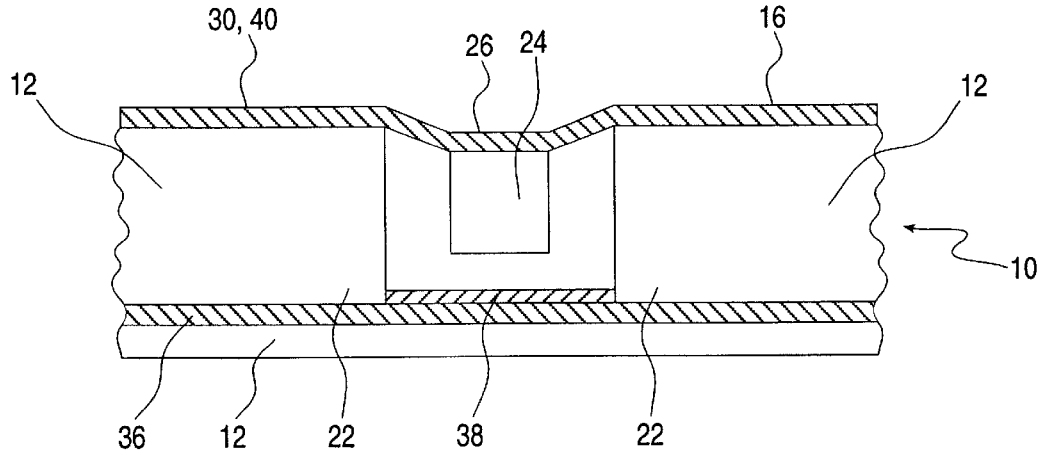
Figure 8C:
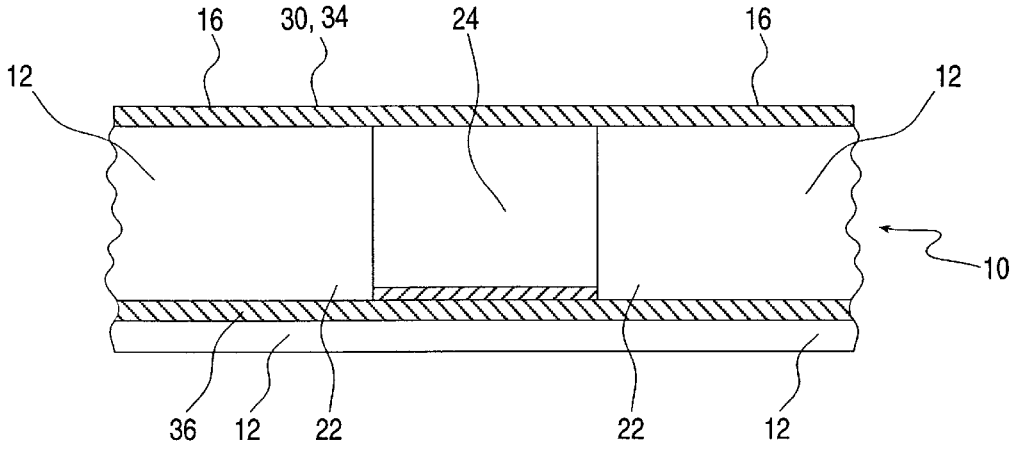
Figure 8D:
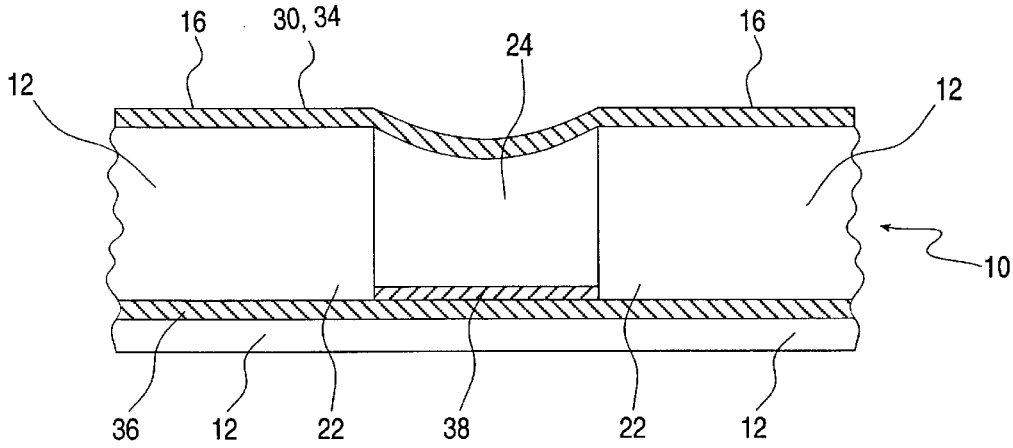
Figure 9A:
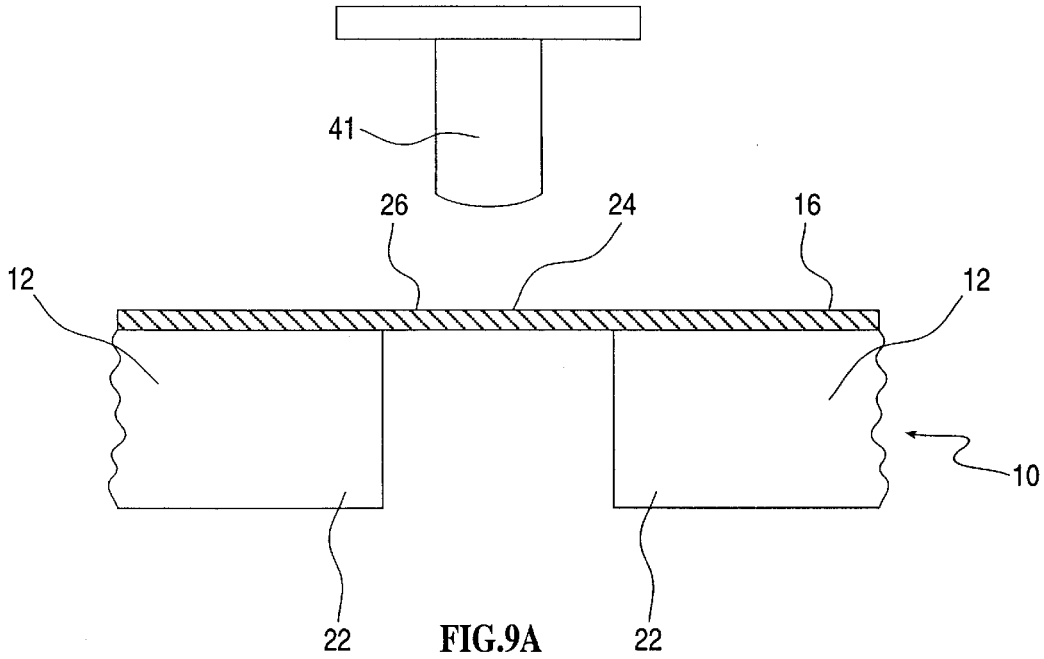
FIGS. 9*a–d* are cross sectional views of printing cells used in the printing plate according to still another embodiment of the present invention, actuated via an external mechanical actuating mechanism.
Figure 9B:
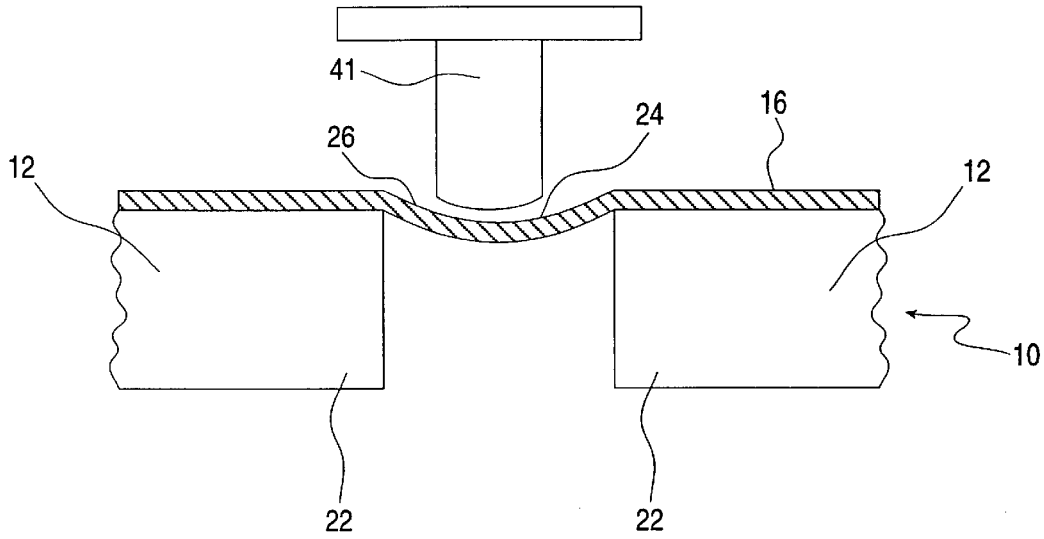
Figure 9C:
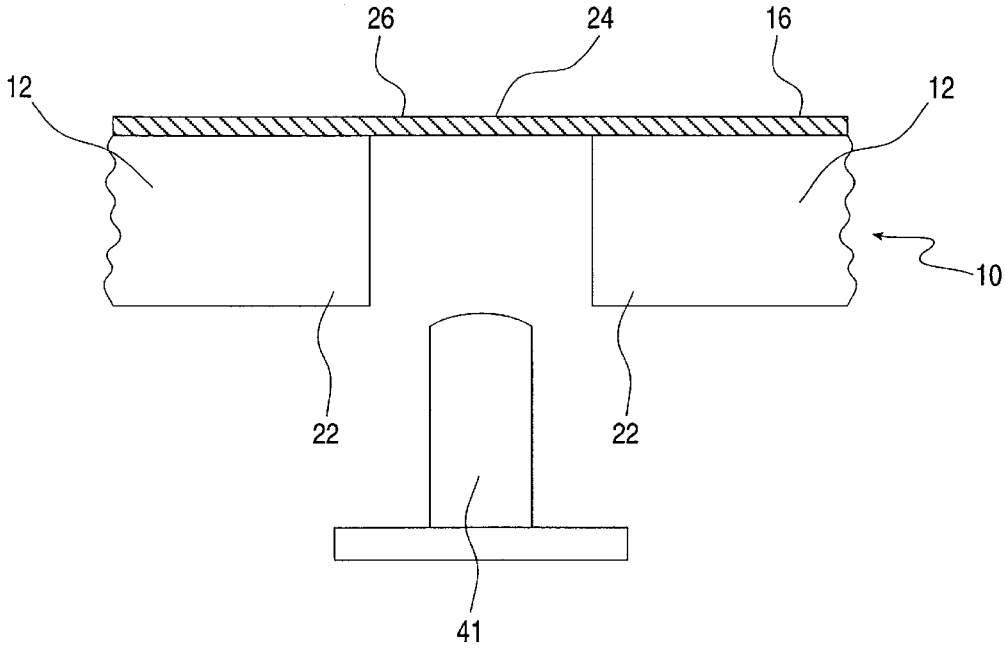
Figure 9D:
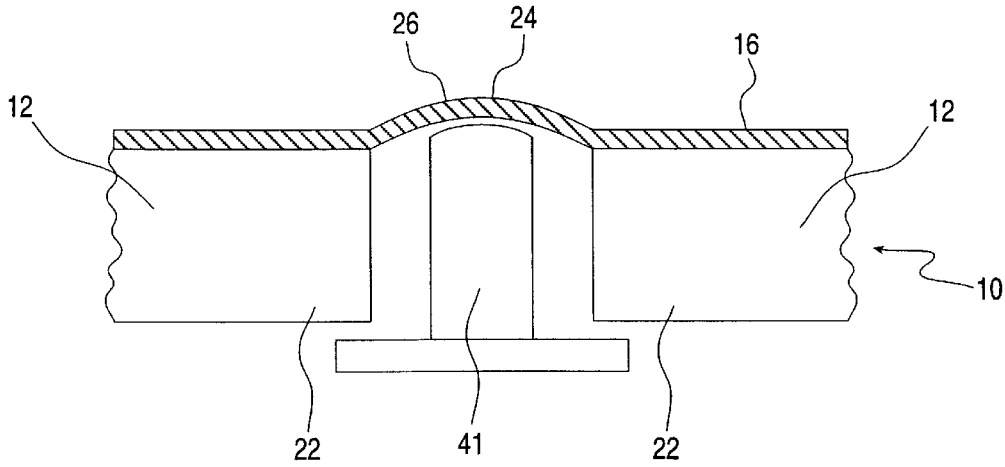

More specifically, in FIGS. 8*a*–*d*, membrane 30 is electrically conductive, and so serves as both printing face 16 and electrode 34. FIGS. 8*a* and 8*c* show the configuration of cell 14 when electrodes 34 and 36 are not charged: face 26 of translating element 24 is level with the rest of printing face 16, and cell 14 is in its non-printing mode. FIGS. 8*b* and 8*d* show the configuration of cell 14 when electrodes 34 and 36 are counter charged: face 26 of translating element 24 is recessed from the rest of printing face 16. Note that in FIGS. 8*c* and 8*d,* the portion of membrane 30 itself that covers cell 14 is translating element 24.

In the examples of FIGS. 9*a–d,* a mechanical actuator 41, shaped, for example, as a pin, serves to translate translating element 24 with respect to stationary guiding element 22, so as to recess or protrude face 26 of element 24 with respect to face 16 of plate 10 for recess or relief printing.

Figure 10:
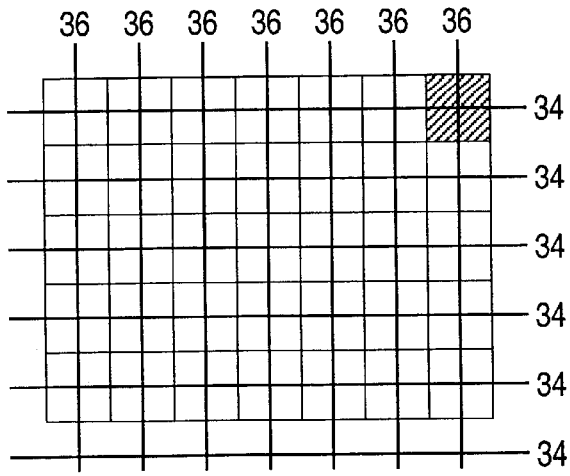
FIG. 10 is a schematic depiction of a grid of electrode lines employed in the printing plate according to the present invention.

As shown in FIG. 10, electrodes 34 and 36 according to a preferred embodiment of the present invention are shared among a plurality of cells 14. Thus, according to one preferred embodiment, a plurality of electrodes 34 are arranged substantially parallel to one another, whereas a plurality of electrodes 36 are arranged parallel to one another and orthogonal to electrodes 34 so as to form a grid structure. Each of electrodes 34 can acquire either a low charge or a high charge, whereas each of electrodes 36 can acquire either a low counter charge or a high counter charge. Only a combination of a high charge and a high counter charge between crossing electrodes 34 and 36 is sufficient to translate translating element 24 of a cell 14 located at the crossing point of the electrodes, whereas a combination of a low charge and a low counter charge between crossing electrodes 34 and 36 is sufficient to retain translating element 24 of a cell 14 located at the crossing point of the electrodes in its translated position.

Such an arrangement results in that each desired cell 14 can be transformed from a printing mode to a non-printing mode and vice versa by selectively and sequentially operating pairs of crossing electrodes 34 and 36 to become low or high charged or counter charged, as appropriate.

It will, however, be appreciated that in case of a membrane which has inherent properties for retaining its translated position, there is no requirement for application of force to retain the printing and/or non-printing modes of cell 14.

Figure 11:
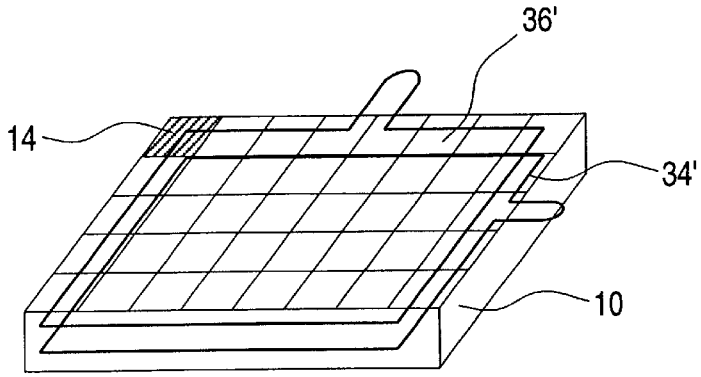
FIG. 11 is a perspective view of a pair of plate electrodes employed in the printing plate according to the present invention.

As shown in FIG. 11, in case that each of printing cells 14 is transformed from its printing mode to its non-printing mode and vice versa by the use of external magnetic or electromagnetic force or external mechanical force, a pair of plate electrodes 34' and 36' within plate 10 can be used to retain each of cells 14 in its printing mode, or alternatively, in its non-printing mode, if so required. It will be appreciated that a combination of line electrodes as shown in FIG. 10 and of a plate electrode as shown in FIG. 11 can similarly be employed.

Figure 12:
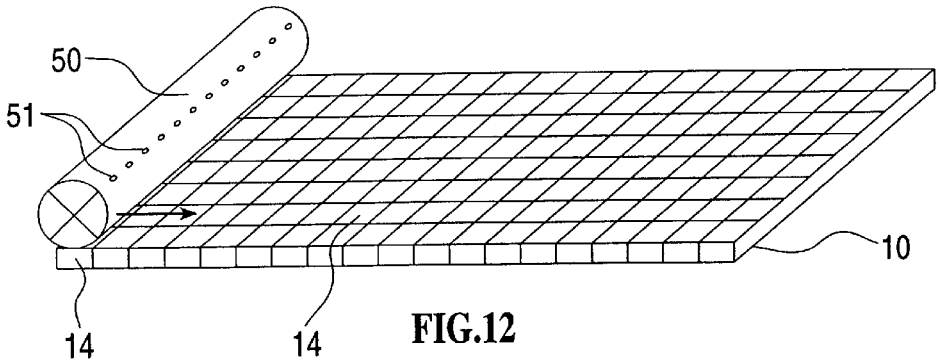
FIG. 12 is a perspective view of a printing system according to the present invention.

As shown in FIG. 12, an electromagnetic or a mechanical force can be applied to each of cells 14 of plate 10 by means of an external mechanism which is realized in the example given as roller 50, having at least one line of alternatable electromagnets or mechanical (e.g., retractable/extendible pins) actuators 51, so as to effect mode transformation of cells 14 line by line (or row by row) by rolling roller 50 in close proximity or in contact with plate 10, either from above, or underneath, depending on the specific configuration. Other configurations of the external mechanism are envisaged, such as a robotic arm supplemented with the line of actuators 51.

Alternatively, a mechanism, such as a roller supplemented with fixed pins or a pliable soft pressable surface, a pair of plate electrodes, a plate magnet or a plate electromagnet can be employed to activate every single printing cell of a plate according to the present invention into its printing (or non-printing) mode, whereas retaining electrostatic, magnetic or electromagnetic forces selectively employed to retain a fraction of desired cells at their printing (or non-printing) mode, while allowing all of the other cells to engage their non-printing (or printing) mode.

It will be appreciated that embodiments according to the present invention wherein the printing face of the plate is covered with a membrane and actuation is effected from the non-printing face of the plate, see for example FIGS. 5*b,* 5*e–f,* 8*a–d* and 9*c–d* are advantageous because the membrane protect the electromechanical inner components forming the printing cells of the plate from possible deleterious effects imposed by the printing substance.

Most of the embodiments presented herein for the printing plate according to the present invention call for the fabrication of sub-millimetric mechanical and/or electromechanical elements. Incorporating known microelectronics and micromechanical manufacturing methods will allow the realization of these elements. The following sections provide some examples for suitable fabrication schemes for the printing plate according to the present invention.

Most of the configurations of the printing plate presented herein require the formation of holes or recessions arranged in a matrix to thereby realize the stationary guiding elements. The holes or recessions can be made in a dielectric material such as, but not limited to, a glass plate. Patterning the holes can be effected by covering the glass plate with a suitable photoresist or etching mask (e.g., silicon carbide or silicon nitride etching mask). The mask is then patterned and the holes are etched by, for example, concentrated hydrofluoric acid (HF) solution. Alternatively, polymeric substrates can be used and be patterned and etched in a similar manner, using appropriate solvents to etch such substrates. In this way either fully penetrating holes, or alternatively depressions or recessions can be formed. The membranes/electrodes lines or layers are then applied as film coats or as thicker coats having layered portions thereof paternly removed so as to achieve the desired membrane configuration. Patterning and etching thereof can be applied as desired to remove portions of the coats. Additional coats can be fabricated as desired to obtain any of the configurations of the printing plate described herein.

Electroplating procedures can also be employed. As opposed to etching techniques which are directed at patterned elimination of details, electroplating procedures are designed to form patterned details. Electroplating procedures alone or in combination with additional etching steps are preferably employed according to the present invention to form portions of the translating elements, which translate within the stationary guiding elements.

Thus by combining appropriate etching and electroplating techniques, one ordinarily skilled in the art would known how to construct the printing plate according to any of its above described configurations. Further details relating to the fabrication of microelectronic and micromechanical components, etching and electroplating techniques, in particular are found in a variety of text books, such as for example, "Journal of Microelectromechanical Systems", edited by the IEEE, "Journal of Micromechanics and Microengineering", edited by the Institute of Physics (IOP) England, "Handbook of Thin Film Technology", L. I. Maissel and R. G. Lang, Eds., McGraw Hill, 1970, "Fundamentals of Microfabrication", Marc Madou, CRC Press, 1998, which are incorporated by reference as if fully set forth herein.

The present invention opens new horizons for the printing industry. The technology described herein is basically limited to the plate itself which is therefore operable with existing printing machines, to thereby provide digital printing usable for low as well as mass production of printed material and which can be readily personalized.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A reusable printing plate for recess or relief printing, the reusable printing plate comprising:

(a) plurality of adjacent printing cells, each of said plurality of adjacent printing cells being independently alternatable at least between a printing mode, in which a printing cell of said plurality of adjacent printing cells acquires a first configuration adapted for receiving and retaining thereat a printing substance, and a non-printing mode, in which a printing cell of said plurality of adjacent printing cells acquires a second configuration adapted for not receiving or retaining thereat the printing substance; and (b) an internal mechanism for independently alternating each of said plurality of adjacent printing cells between said printing and non-printing modes.

2. The reusable printing plate of claim 1, wherein printing cells of said plurality of adjacent printing cells which are in said printing mode are elevated respective to printing cells of said plurality of adjacent printing cells which are in said non-printing mode.

3. The reusable printing plate of claim 1, wherein printing cells of said plurality of adjacent printing cells which are in said printing mode are recessed respective to printing cells of said plurality of adjacent printing cells which are in said non-printing mode.

4. The reusable printing plate of claim 1, wherein each of said adjacent printing cells includes a stationary guiding element and a translating element translatable within said stationary guiding element.

5. The reusable printing plate of claim 4, wherein said translating element includes a flexible membrane connecting said stationary guiding element and said translating element.

6. The reusable printing plate of claim 4, wherein said translating element includes a membrane selected from the group consisting of a buckling membrane, a bi-material element membrane and a shape memory alloy membrane.

7. The reusable printing plate of claim 1, wherein each of said adjacent printing cell includes a stationary guiding element and a translating element translatable within said stationary guiding element.

8. The reusable printing plate of claim 7, wherein said mechanism for independently alternating each of said plurality of adjacent printing cells between said printing and non-printing modes operates by selectively actuating or deactuating electrostatic attraction or repulsion forces to thereby translate said translating elements in respect to their stationary guiding elements.

9. The reusable printing plate of claim 7, wherein said mechanism for independently alternating each of said plurality of adjacent printing cells between said printing and non-printing modes operates by selectively actuating or deactuating magnetic or electromagnetic attraction or repulsion forces to thereby translate said respective translating elements in respect to their stationary guiding elements.

10. The reusable printing plate of claim 7, wherein said mechanism for independently alternating each of said plurality of adjacent printing cells between said printing and non-printing modes operates by selectively applying mechanical forces to thereby translate said respective translating elements in respect to their stationary guiding elements.

11. A recess or relief printing method comprising the steps of:

(a) providing a reusable printing plate including a plurality of adjacent printing cells, each of said plurality of adjacent printing cells being independently alternatable at least between a printing mode, in which a printing cell of said plurality of adjacent printing cells acquires a configuration adapted for receiving and retaining thereat a printing substance, and a non-printing mode, in which a printing cell of said plurality of adjacent printing cells acquires a configuration adapted for not receiving or retaining thereat a printing substance, each of said adjacent printing cells including a stationary guiding element and a translating element translatable within said stationary guiding element;

(b) further providing a mechanism for independently alternating each of said plurality of adjacent printing cells between said printing and non-printing modes by selectively translating said translating elements with respect to their stationary guiding elements;

(c) via said mechanism, selecting printing cells of said plurality of adjacent printing cells to be in said printing mode;

(d) providing printing cells being in said printing mode with said printing substance; and (e) transferring at least a portion of said printing substance from said printing cells being in said printing mode to a printable substrate.

12. The method of claim 11, wherein printing cells of said plurality of adjacent printing cells which are in said printing mode are elevated respective to printing cells of said plurality of adjacent printing cells which are in said non-printing mode, so that providing said printing cells being in said printing mode with said printing substance is effected by applying said printing substance onto elevated regions of said reusable printing plate.

13. The method of claim 11, wherein printing cells of said plurality of adjacent printing cells which are in said printing mode are recessed respective to printing cells of said plurality of adjacent printing cells which are in said non-printing mode, so that providing said printing cells being in said printing mode with said printing substance is effected by applying said printing substance into recessed regions of said reusable printing plate.

14. The method of claim 11, wherein said translating element includes a flexible membrane connecting said stationary guiding element and said translating element.

15. The method of claim 11, wherein said translating element includes a membrane selected from the group consisting of a buckling membrane, a bi-material element membrane and a shape memory alloy membrane.

16. The method of claim 11, wherein said mechanism for independently alternating each of said plurality of adjacent printing cells between said printing and non-printing modes operates by selectively actuating or deactuating electrostatic attraction or repulsion forces to thereby translate said translating elements in respect to their stationary guiding elements.

17. The method of claim 11, wherein said mechanism for independently alternating each of said plurality of adjacent printing cells between said printing and non-printing modes operates by selectively actuating or deactuating magnetic or electromagnetic attraction or repulsion forces to thereby translate said respective translating elements in respect to their stationary guiding elements.

18. The method of claim 11, wherein said mechanism for independently alternating each of said plurality of adjacent printing cells between said printing and non-printing modes operates by selectively applying mechanical forces to thereby translate said respective translating elements in respect to their stationary guiding elements.

19. A printing system comprising:

(a) a reusable printing plate for recess or relief printing including a plurality of adjacent printing cells, each of said plurality of adjacent printing cells being independently alternatable at least between a printing mode, in which a printing cell of said plurality of adjacent printing cells acquires a first configuration adapted for receiving and retaining thereat a printing substance, and a non-printing mode, in which a printing cell of said plurality of adjacent printing cells acquires a second configuration adapted for not receiving or retaining thereat the printing substance, each of said adjacent printing cells including a stationary guiding element and a translating element translatable within said stationary guiding element; and (b) an external mechanism for independently alternating each of said plurality of adjacent printing cells between said printing and non-printing modes.

20. The printing system of claim 19, wherein said external mechanism includes at least one mechanical actuator for translating said translating elements in respect to their stationary guiding elements.

21. A reusable printing plate for recess or relief printing, the reusable printing plate comprising a plurality of adjacent printing cells, each of said plurality of adjacent printing cells being independently alternatable at least between a printing mode, in which a printing cell of said plurality of adjacent printing cells acquires a first configuration adapted for receiving and retaining thereat a printing substance, and a non-printing mode, in which a printing cell of said plurality of adjacent printing cells acquires a second configuration adapted for not receiving or retaining thereat the printing substance, each of said adjacent printing cells including a stationary guiding element and a translating element translatable within said stationary guide element.

* * * * *